US006673152B2

(12) United States Patent
Guzzon et al.

(10) Patent No.: US 6,673,152 B2
(45) Date of Patent: Jan. 6, 2004

(54) RIGHT ANGLE GLUER

(75) Inventors: Robert D. Guzzon, Roverford, PA (US); Thomas Kane, Princeton Junction, NJ (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/288,847

(22) Filed: Nov. 6, 2002

(65) Prior Publication Data

US 2003/0084846 A1 May 8, 2003

Related U.S. Application Data

(60) Provisional application No. 60/345,942, filed on Nov. 7, 2001.

(51) Int. Cl.[7] ..... B05B 7/00

(52) U.S. Cl. ..... 118/315; 156/356; 156/442.2; 53/376.5; 53/383.1; 493/128; 493/264

(58) Field of Search ..... 53/376.5, 383.1; 156/290, 356, 442.2; 118/313, 315, 324, 669, 682, DIG. 3; 427/421, 285, 286; 493/128, 264

(56) References Cited

U.S. PATENT DOCUMENTS

| | | | | | |
|---|---|---|---|---|---|
| 3,981,122 | A | * | 9/1976 | Johnson | 53/374 |
| 3,981,123 | A | * | 9/1976 | Flanagan | 53/374 |
| 4,087,303 | A | * | 5/1978 | Strzalka | 156/357 |
| 4,156,398 | A | * | 5/1979 | McDaniel | 118/2 |
| 4,256,526 | A | * | 3/1981 | McDaniel | 156/295 |
| 4,503,659 | A | * | 3/1985 | Sherman | 53/491 |
| 4,976,672 | A | * | 12/1990 | Harrison et al. | 493/130 |
| 5,116,322 | A | * | 5/1992 | Chromowsky | 53/485 |
| 5,141,111 | A | * | 8/1992 | Licht | 209/558 |
| 5,188,695 | A | * | 2/1993 | Colton | 156/356 |
| 5,379,573 | A | * | 1/1995 | Greenwell | 53/491 |
| 5,732,533 | A | * | 3/1998 | Focke et al. | 53/466 |
| 5,992,494 | A | * | 11/1999 | Focke et al. | 156/578 |
| 6,012,503 | A | * | 1/2000 | Balder | 156/578 |
| 6,164,568 | A | * | 12/2000 | Muller et al. | 239/586 |
| 6,170,239 | B1 | * | 1/2001 | Focke et al. | 53/491 |
| 6,341,474 | B1 | | 1/2002 | Focke et al. | 53/463 |
| 6,413,315 | B1 | | 7/2002 | Hendricks | 118/222 |

* cited by examiner

*Primary Examiner*—Richard Crispino
*Assistant Examiner*—Michelle Lazor
(74) *Attorney, Agent, or Firm*—Wood, Herron & Evans, L.L.P.

(57) ABSTRACT

A right-angle gluer for applying a transverse bead of an adhesive to a blank being conveyed in a machine direction orthogonal to the transverse direction of glue application. The right-angle gluer includes a coating head operable for applying the transverse adhesive bead and a pivotal mounting assembly that permits adjustment of the positioning and orientation of the coating head relative to the machine direction. The right angle gluer further includes a backup plate positioned upstream of the coating head that reduces or prevents buckling of the conveyed blanks.

45 Claims, 8 Drawing Sheets

RIGHT ANGLE GLUER

CROSS-REFERENCE TO RELATED APPLICATIONS

This application claims the benefit under 35 U.S.C. §120 of Provisional Application Serial No. 60/345,942, filed Nov. 7, 2001 and currently pending. The disclosure of that provisional application is hereby fully incorporated by reference herein.

FIELD OF THE INVENTION

The present invention relates to adhesive dispensing systems and, in particular, to adhesive application systems for applying a bead of an adhesive to each of a series of blanks moving transverse to the direction of adhesive application.

BACKGROUND OF THE INVENTION

Many commercial processes produce products from blanks of a foldable material, such as paper or a thin cardboard, in a multi-station automated process. To create structures such as pockets, portions of the blanks, such as flaps, are glued with a straight-line gluer and subsequently folded in a manner to form the pocket. To that end, a series of blanks are conveyed past one or more spaced-apart adhesive applicators of the straight-line gluer. One or more glue beads are applied to each blank in a direction generally aligned with its direction of travel in the gluer or the machine direction. Each blank makes a single pass through the straight-line gluer so that all glue beads are applied simultaneously.

One conventional method of creating a pocket from a generally rectangular blank 5 is diagrammatically illustrated in FIG. 1. To facilitate this method, the blank 5 is die cut as a rectangular sheet with an integral flap 5*a* provided on a leading edge. In this method, a straight-line gluer applies two parallel adhesive beads 6*a,b* to the flap 5*a* that are aligned parallel to a machine direction (MD) and positioned near opposite side edges of the flap 5*a*. After the adhesive beads 6*a,b* are applied, the flap 5*a* is folded over the blank 5 at a fold line 5*b* and adhesively bonded thereto along the lines of contact with the adhesive beads 6*a,b* to form the pocket. The fold line 5*b* creates a bottom seam for the pocket. However, the folding step of this conventional process is time-consuming and inefficient because several inches of the flap 5*a* must be guided into a back-fold device and folded in an 180° arc relative to fold line 5*b* to contact the blank 5.

Another conventional method of forming a pocket from a blank 7 is diagrammatically illustrated in FIG. 2. In this method, the blank 7 is die cut with an integral flap 7*a* extending from a side edge. A straight-line gluer applies a bead of adhesive 8*a* near the side edge of the flap 7*a* that is aligned parallel to a machine direction (MD) for purposes of creating a side seam. Another bead of adhesive 8*b* is manually applied by hand to the flap 7*a* in a direction transverse to the machine direction. The integral flap 7*a* is then folded over the blank 7 to adhesively bond along the adhesive beads 8*a,* 8*b* for forming a pocket. However, this conventional process is time-consuming because of the necessity of applying the transverse bead 8*b* of adhesive by hand.

Blanks are typically formed by a die cutting operation that generates significant quantities of waste paper. The ability of conventional straight-line gluers to only apply beads of adhesive in a direction parallel to the machine direction dictates the geometrical configuration or shape of the blanks. The die cutting operation to geometrically shape blanks for the conventional gluing method of FIG. 2 generates excessive amounts of trimmed material. This trimmed material or scrap material produces a waste stream that must be either recycled or discarded.

Thus, a gluer is needed that can rapidly apply a bead of adhesive in an application direction transverse to the machine direction as the blank is conveyed past the adhesive applicators.

SUMMARY OF THE INVENTION

According to the present invention, a dispensing system is provided for applying a transverse bead of an adhesive to a blank being conveyed past a coating head in a first direction on a conveyor. The dispensing system comprises a coating head capable of applying the bead of the adhesive to the blank and a mounting assembly mounted to the conveyor. The mounting assembly orients the coating head in a second direction that is substantially transverse or orthogonal to the first direction for applying the bead of the adhesive transversely to the first direction.

In certain embodiments, the dispensing system is constructed and arranged such that the coating head can be moved vertically over a range of movement relative to a plane containing the blank. In other embodiments, the dispensing system is constructed and arranged such that the coating head can be rolled about the machine direction over a range of angular movement relative to the first direction. In still other embodiments, the dispensing system is constructed and arranged such that the coating head can be angularly pitched transverse to the machine direction over a range of angular movement relative to the first direction. These two degrees of rotational freedom and degree of translational freedom are utilized individually, or in combination, for positioning the coating head relative to the blank.

In certain embodiments, the dispensing system may include a pattern controller for regulating the application of adhesive from the coating head to a surface of the blank. The dispensing system may further include a photosensor for detecting an edge of the blank and providing a signal to the pattern controller for use in triggering the application of adhesive from the coating head to the blank. A bifurcated fiber optic may be interfaced with the photosensor which has an emitter aperture and a receiver aperture aligned with the emitter aperture so that the photosensor operates in an opposed sensing mode.

The present invention drastically reduces the waste of foldable material from the die cutting process because the blanks need not be die cut with an integral side flap that depends from a side edge. Instead, such blanks may be die cut with an integral flap that depends from an end edge. This difference dramatically reduces the trim generated by the die cutting operation to prepare blanks suitable for use with the present invention compared with die cutting to prepare blanks suitable for conventional straight-line gluers.

The dispensing system may include a lower bracket disposed upstream from the coating head for applying an upward force against the blank. In one embodiment, the lower bracket includes a reduced friction strip positioned adjacent to the coating head and in contact with the blank for reducing the incidence of blank buckling.

The present invention also eliminates the need to rely on a back-fold device or a manual folding operation for folding the flap to form the pocket. Furthermore, the right angle glue of the present invention applies the transverse adhesive bead in a fully automated manner. By eliminating the conventional manual application of the transverse adhesive bead, the pocket-forming process is accelerated so that productivity is enhanced and blank throughput is improved. In addition, the right angle glue of the present invention provides standardized, accurate, consistent, reproducible and reliable adhesive application that represents an improvement over manual application of the transverse bead.

BRIEF DESCRIPTION OF THE DRAWINGS

Various advantages, objectives, and features of the invention will become more readily apparent to those of ordinary skill in the art upon review of the following detailed description of the preferred embodiments, taken in conjunction with the accompanying drawings.

DETAILED DESCRIPTION

Figure 4:
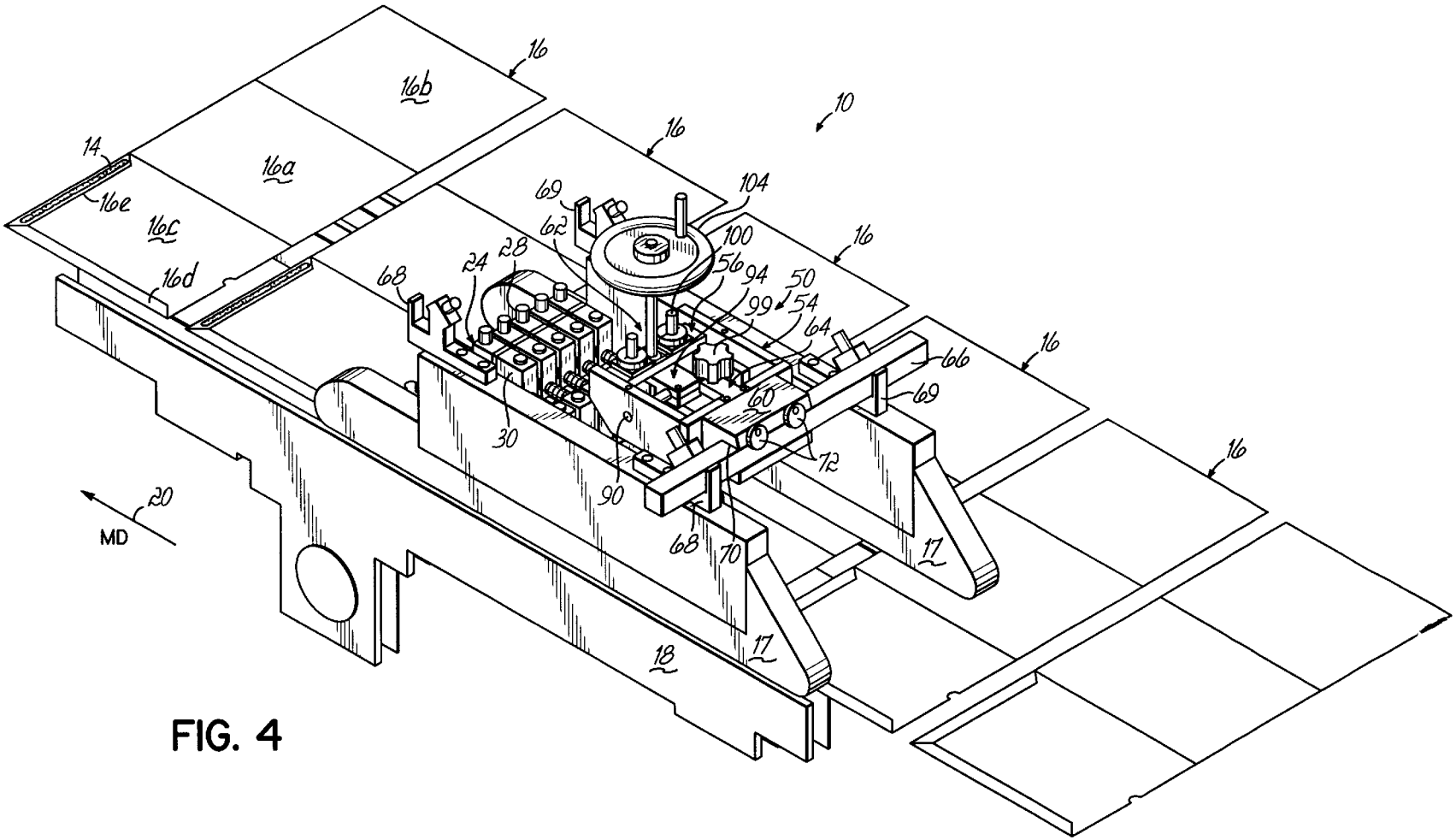
FIG. 4 is a perspective view of a right-angle gluer of the present invention with the belts of the material conveyor removed for clarity.
Figure 5:
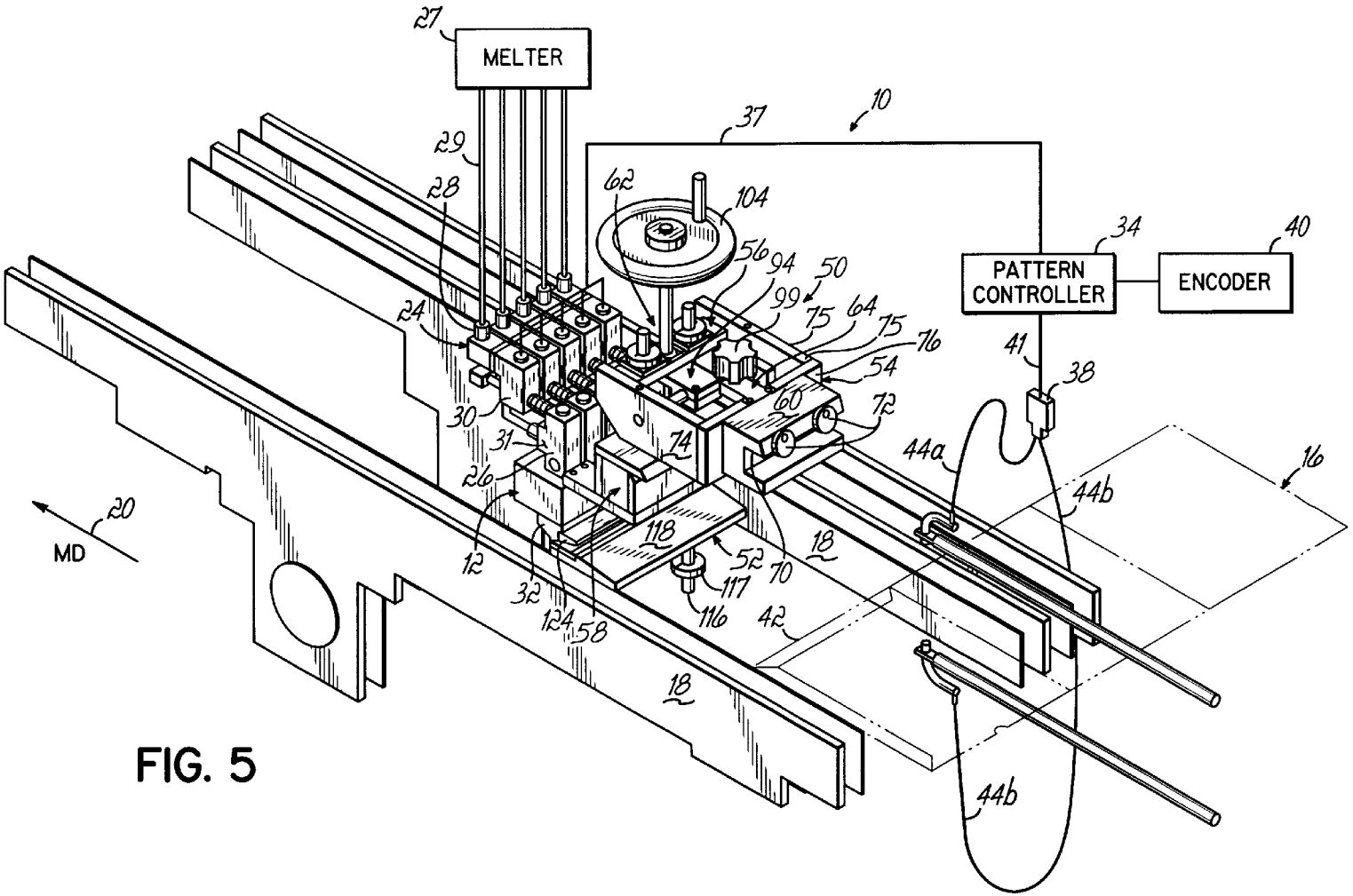
FIG. 5 is a perspective view similar to FIG. 4 showing the photosensor and pattern controller with the blanks removed for clarity.
Figure 6:
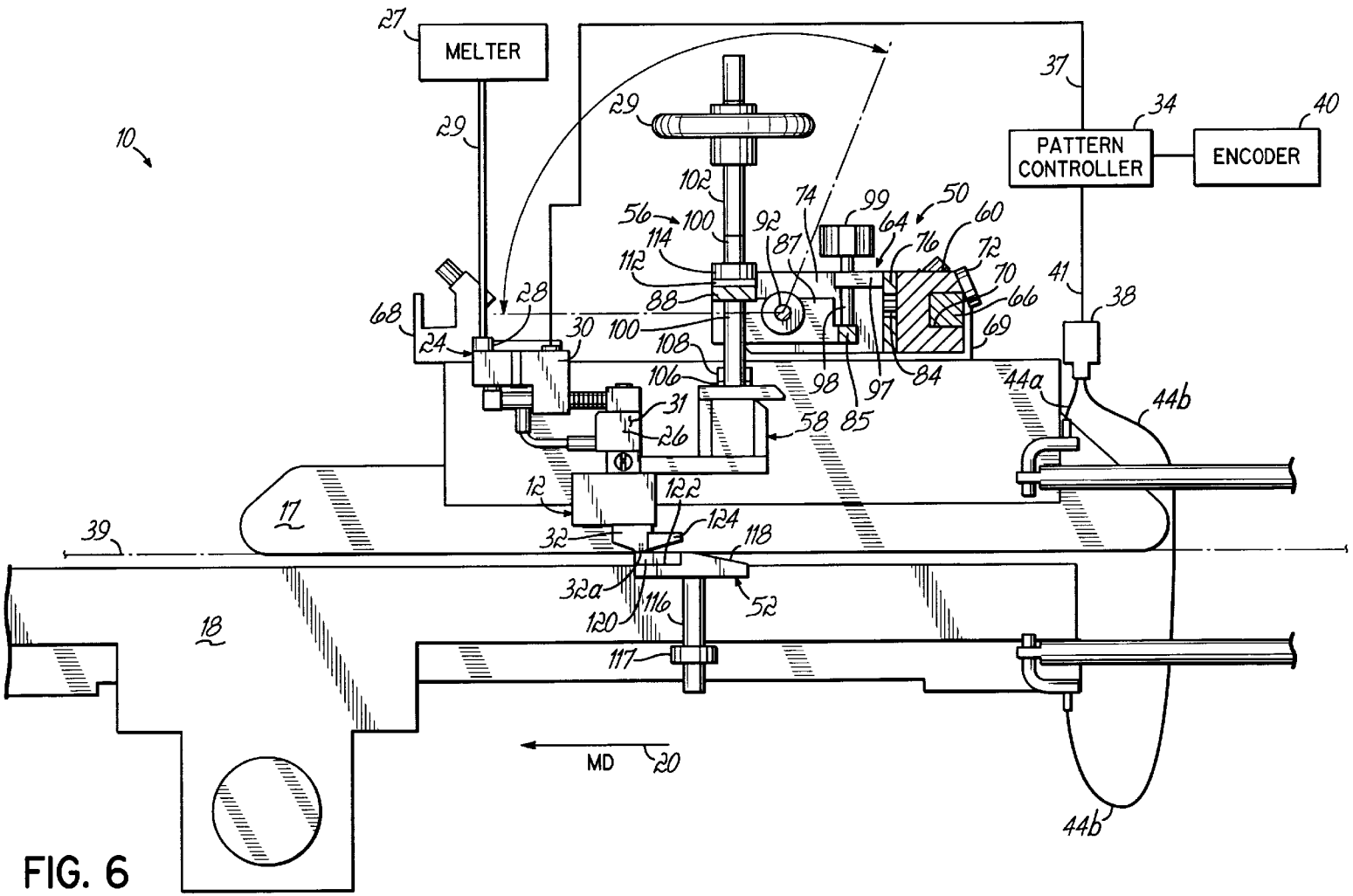
FIG. 6 is a side view of the right angle gluer of the present invention.
Figure 6A:
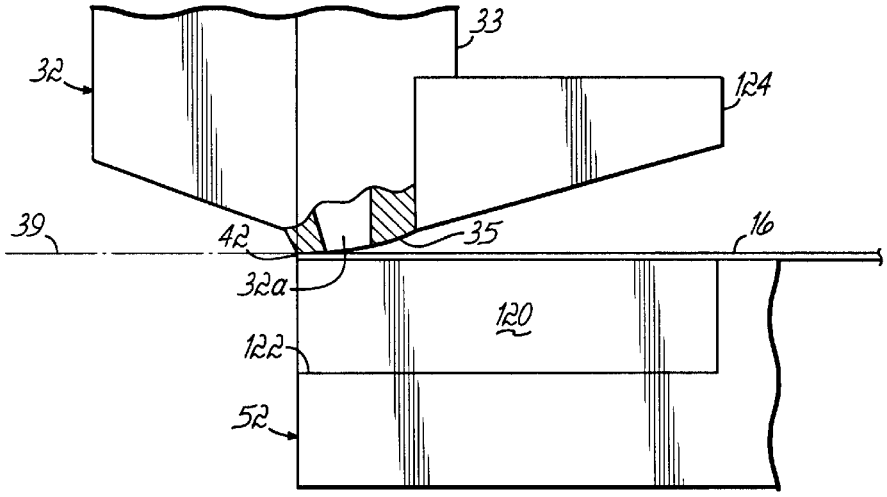
FIG. 6A is an enlarged view of a portion of FIG. 6.
Figure 12:
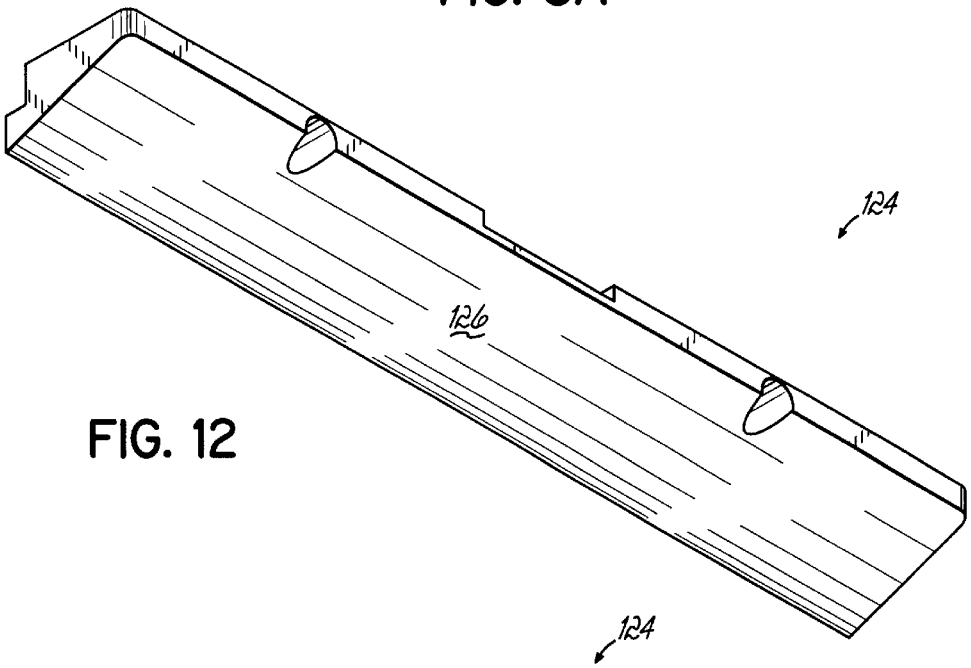
FIG. 12 is a perspective view of the lower bracket of the present invention.

With reference to FIGS. 4–6, a right-angle gluer 10 of the present invention comprises one station in a multi-station production line that receives a series of blanks of a foldable stock material, such as paper or thin cardboard, die cut from stacked layers of bulk foldable material. The production line forms articles having adhesively-bonded, folded sections, such as pockets, from those blanks.

With continued reference to FIGS. 4–6, the right-angle gluer 10 includes a coating head 12 operable to apply a transverse bead 14 (FIG. 4) of an adhesive to each of a series of blanks 16 serially transported past the gluer 10. The environment of the right-angle gluer 10 is a dual-belt conveyor system that pinches or captures a portion of each blank 16 between a parallel pair of endless belts (not shown) that are continuously rotating on an upper carriage 17 and a lower carriage 18, respectively. The transverse adhesive bead 14 extends in a direction perpendicular or orthogonal to the longitudinal direction of travel of the blanks 16 or the machine direction (MD), indicated by a directional arrow labeled with reference numeral 20. Because the accuracy of glue application and speed of the gluing operation are competing goals, the speed of the conveyor system is typically set to convey the blanks 16 past the right-angle gluer 10 with a linear velocity or rate as quickly as required by the production line while still obtaining accurate adhesive placement. The transverse bead 14 has a length measured in the transverse or cross-machine direction, orthogonal to machine direction 20, that is greater than its width in the machine direction 20.

The blanks 16 are illustrated in FIG. 4 as consisting of a rectangular front sheet 16*a,* a rectangular back sheet 16*b,* and a rectangular flap 16*c* having a longitudinal tabbed edge 16*d* and a transverse tabbed edge 16*e*. For purposes of illustration, the flap 16*c* has rectangular dimensions similar to the rectangular dimensions of the front and back sheets 16*a,b*. However, the configuration and dimensions of the flap 16*c* relative to the front and back sheets 16*a, b* are not so limited. The coating head 12 of the right-angle gluer 10 applies the transverse bead 14 of adhesive to the transverse tabbed edge 16*e* of the flap 16*c*. Downstream from the right-angle gluer 10, another adhesive dispenser (not shown) applies a longitudinal bead of adhesive to the longitudinal tabbed edge 16*d* and a manual or automatic folder (not shown) folds the flap 16*c* transversely over the front sheet 16*a* to create a pocket capable of receiving items therein, such as 8½" by 11" sheets of paper and other objects.

Figure 1:
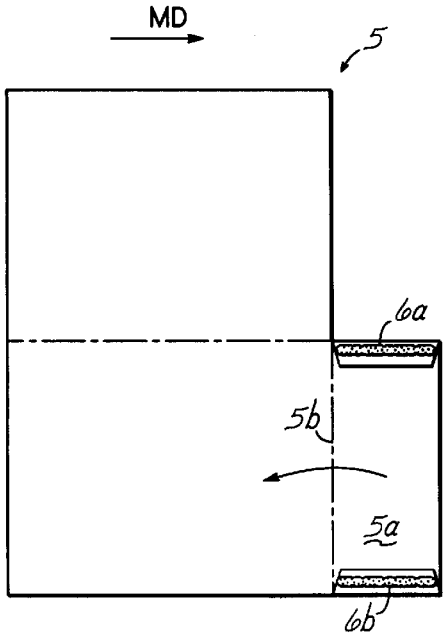
PRIOR ART FIG. 1
FIG. 1 is a diagrammatic view of a prior art method of gluing and folding a blank to create a pocket.
Figure 2:
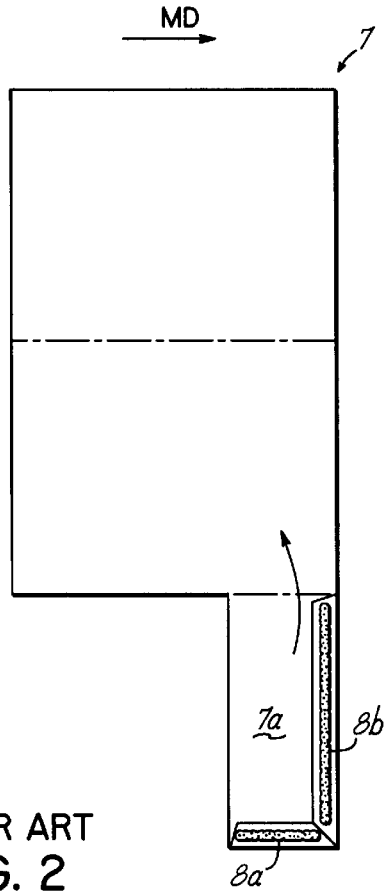
PRIOR ART FIG. 2
FIG. 2 is a diagrammatic view of another prior art method of gluing and folding a blank to create a pocket.
Figure 3:
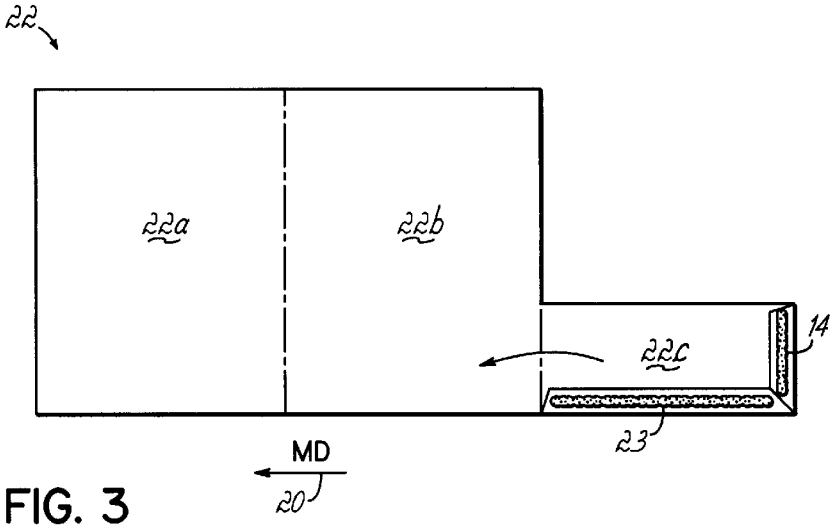
FIG. 3 is a diagrammatic view of a method of gluing and folding a blank to create a pocket according to the principles of the present invention.

With reference to FIG. 3, the right-angle gluer 10 of the present invention is capable of applying the transverse bead 14 of adhesive to a blank 22 having a different configuration than blank 16 of FIG. 4. Blank 22 includes a rectangular front sheet 22*a,* a rectangular back sheet 22*b,* and an integral strip or flap 22*c* extending from an end edge of the back sheet 22*b*. The coating head 12 of the right-angle gluer 10 of the present invention applies the transverse adhesive bead 14 of adhesive near a trailing edge of the flap 22*c*. The blank 22 is moved in a machine direction 20 that is perpendicular to the direction in which the transverse adhesive bead 14 is applied. Downstream from the right-angle gluer 10, an independent adhesive dispenser (not shown) applies a longitudinal bead 23 of adhesive near a side edge of the flap 22*c*. The flap 22*c* is then folded over the back sheet 22*b* and, as a result, flap 22*c* is adhesively bonded by the transverse adhesive bead 14 and longitudinal adhesive bead 23 to the back sheet 22*b*. According to the principles of the invention, the blank 22 may be formed with flap 22*c* extending from an end edge, rather than a side edge as is conventional with straight-line gluers.

With reference to FIGS. 4–6, the coating head 12 of the right-angle gluer 10 includes an adhesive manifold 24 and a plurality of, for example, five adhesive guns 26. A flow of a filtered adhesive is pumped from a melter 27 through individual flexible hoses 29 to respective hose connections 28 on an upper face of the adhesive manifold 24. The adhesive manifold 24 and the hoses 29 between the right-angle gluer 10 and the melter 27 are electrically heated to keep the adhesive at the proper viscosity (i.e., application temperature) for dispensing on blank 16 and may include conventional heating elements and temperature sensors as required. The melter 27 includes a tank or reservoir, one or more pumps such as gear pumps, and a temperature-controlled heating system for heating the walls of the reservoir to melt solid adhesive and heat the melted adhesive to the desired application temperature. A melter particularly suitable for use in the present invention is the model VL 500 Melter available commercially from Nordson Corporation. The hoses 29 are any hoses constructed to withstand the hydraulic pressure and may include, in addition to heating structure, a temperature sensor for use in monitoring the hose heating. The adhesive manifold 24 also provides mechanical support for the adhesive guns 26 and provides an attachment site for the slot nozzles 32, described below.

With reference to FIGS. 4–6 and 6A, each of the adhesive guns 26 is coupled in fluid communication with the adhesive manifold 24 for receiving a corresponding flow of adhesive. Each adhesive gun 26 includes a valve assembly (not shown) controlled by operation of an electro-pneumatic solenoid valve 30. The solenoid valves 30 are energized by a pattern controller 34 for regulating the flow of adhesive to a discharge outlet 32*a* provided in a slot nozzle 32. The adhesive guns 26 and the solenoid valves 30 are characterized by a cycle time for actuating each adhesive gun 26 from a closed position, in which adhesive cannot flow to the discharge outlets 32*a,* to an open position, in which adhesive flows to the discharge outlets 32*a,* and returning to the closed position. This defines the response time of the adhesive gun 26 to an instruction from the pattern controller 34 energizing the solenoid valves 30 for applying transverse bead 14.

Each slotted discharge outlet 32*a* has a major axis or length that is oriented transverse or orthogonal to the machine direction 20. The length of each discharge outlet 32*a* is aligned into and out of the plane of the page of FIG. 6*a*A. Adhesive directed from the discharge outlets 32*a* is applied as transverse bead 14 to each of the blanks 16 being transported past the right-angle gluer 10. The length of the slotted discharge outlet 32*a* determines the transverse dimension or length of a bead segment contributing to the overall transverse dimension of the bead 14 of adhesive applied to the blank 16. The slotted discharge outlet 32*a* is located in a mouthpiece 33, which, during the application process, has a curved contact surface 35 at least partly in contact with the blank 16 moving relative to the discharge outlet 32*a*. The contact surface 35 has a transverse cross-sectional that is curved axially and diverges relative to the planar surface of the blank 16. The planar surface of the blank 16 is aligned with a paper line 39 of the conveyor, which is defined between the parallel belts. During operation of the right-angle gluer 10, at least a portion of the curved contact surface 35 is lower than or below the paper line 39 so that the curved contact surface 35 deflects the blank 16 downward immediately before adhesive application from discharge outlets 32*a*.

Although each of the transverse glue beads 14 is depicted in FIGS. 3 and 4 as being continuous, each transverse glue bead 14 consists of a number of transversely spaced bead segments having a desired total transverse dimension transverse to the direction of movement of the blank 16 to obtain the desired bond. The length of the transverse bead 14 of adhesive applied to the blank 16 is selected by varying the number of adhesive guns 26 actively dispensing adhesive from their respective slot nozzles 32 and the width of the discharge outlet 32*a* in each slot nozzle 32. For example, the slot nozzle 32 of each of the five adhesive guns 26 may apply an individual bead segment having a transverse dimension or length of about 38 mm (the approximate width of the discharge outlet) that linearly adjoins, with 1.25 mm gaps between adjacent individual 35 mm beads, others of the bead segments to provide an overall 195 mm long transverse bead 14. If one of the marginal adhesive guns 26 is made inactive, the transverse dimension of the exemplary transverse adhesive bead 14 in FIG. 3 will be reduced by the width of one slot nozzle 32 (i.e., one bead segment or, in the illustrated embodiment, 38 mm). It follows that the adhesive guns 26 may be configured variously to provide beads 14 of differing transverse dimensions. Specifically, the transverse dimension of bead 14 may be varied by altering one, or both, of the width of the individual bead segments or the total number of bead segments. The transverse bead 14 also has a thin and uniform thickness, typically about 1 mil to about 2 mils, so that the appearance of the bonded seam between the flap and underlying front or back sheet is flat and relatively free of bumps or depressions.

Each of the bead segments has well-defined spatial boundaries on its leading and trailing edges that are substantially linear. These boundaries are formed by rapid, intermittent operation of each adhesive gun 26 of the right-angle gluer 10. In particular, the speed with which the flow of adhesive is discontinued or the cycle time, contributes to a so-called suck-back effect that provides a sharply delimited boundary on the trailing edge of the transverse bead 14. The leading edge of the transverse bead 14 also has a sharply delimited edge because of the speed with which the adhesive gun 26 can operate to create a flow of adhesive from discharge outlets 32*a*. An adhesive gun 26 particularly suitable for use in the present invention is the model EP-10 adhesive gun manufactured by Nordson Corporation (Westlake, Ohio), which is incorporated into the model EP-11 coating head 12 also manufactured by Nordson Corporation. A version of the EP-10 adhesive gun and a nozzle suitable for use with the present invention is disclosed in commonly-assigned U.S. Pat. No. 6,164,568 entitled "Device for Applying Free-flowing Material to a Substrate, in Particular for Intermittent Application of Liquid Adhesive." The disclosure of this patent is hereby incorporated by reference herein in its entirety.

The adhesive used to form the transverse adhesive bead 14 is preferably a pressure-sensitive adhesive that remains tacky after curing or setting for an open time during which to make a serviceable bond. Exemplary pressure sensitive adhesives are manufactured by National Adhesive and have a viscosity of about 1200 centipoise at an application temperature of about 350° F. The ability of pressure sensitive adhesive to form a bond with minimal or no compression or holding accelerates the pocket-forming process as compared with cold adhesives, which require a compression time of about 1 minute to form a serviceable bond, and also reduces the incidence of skewing or movement of the flap relative to the sheet so that the pocket is not correctly positioned after the glue sets. Pressure sensitive adhesives are particularly useful in conjunction with the right-angle gluer 10 of the present invention for bonding blanks of coated or laminated foldable material having a glossy finish.

With reference to FIGS. 5 and 6, the pattern controller 34 regulates adhesive placement on each blank 16 utilizing information received from a photosensor 38 and information received from an encoder 40 that tracks the linear velocity of the belts of the conveyor system. The microprocessor-based pattern controller 34 is programmable for accurately and reproducibly energizing the solenoid valves 30 via transmission line 37 to create the open and closed conditions so as to regulate the flow of adhesive to the discharge outlet 32*a* of each of the slot nozzles 32 and apply the transverse bead 14 on each blank 16. The intermittent flow regulation determines the onset of dispensing and the dispensing time of the coating head 12 and, thereby, the width and placement in the machine direction 20 of the transverse bead 14 between its leading and trailing edges. A particularly suitable pattern controller is the model WM 416 Pattern Controller available commercially from Nordson Corporation (Westlake, Ohio). This particular controller is operable to provide a one millimeter precision in adhesive placement to create the leading and trailing edges of the transverse bead 14. The pattern controller 34 regulates the hydraulic pressure of the adhesive pumped from the melter 27 to the coating head 12 with a pressure transducer (not shown). For example, the hydraulic pressure is reduced if the length of the transverse adhesive bead 14 is shortened by deactivating one or more marginal ones of the adhesive guns 26.

The photosensor 38 relies on a beam of light for detecting the presence of a leading edge 42 (FIG. 4), or other predetermined portion, of each individual blank 16 that is being serially transported past the coating head 12 of the right-angle gluer 10. It is contemplated by the invention that, for example, a trailing edge of each blank 16 may be used as a trigger to indicate the arrival of blank 16 at a specific location at a fixed distance from the coating head 12. As used herein, "leading edge" refers to a portion of the blank 16 that enters the beam of light from photosensor 38 first while "trailing edge" refers to a portion of the blank 16 that exits the beam of light last.

To that end and with reference to FIGS. 5 and 6, the photosensor 38 is positioned upstream from the coating head 12. A signal from the photosensor 28 is provided over a transmission line 41 to the pattern controller 34. The signal is disrupted when the leading edge 42 of the blank 16 is detected. The absence of the signal serves as a trigger signal for pattern controller 34 to energize the solenoid valves 30 substantially simultaneously, in relation to the linear velocity of the belts of the conveyor and time delays in blank transport from the position of the photosensor 28 to the position of the coating head 12, for applying the transverse adhesive bead 14. The photosensor 38 includes an emitter element consisting of one or more light emitting diodes (LED's) that emit light and a receiver element, such as a phototransistor or a photodiode. The emitted light typically has an infrared wavelength, although the invention is not so limited. A suitable photosensor is manufactured by Nordson Corporation (Westlake, Ohio) as part number 131476.

With continued reference to FIGS. 5 and 6, one branch 44*a* of a bifurcated fiber optic conducts the light emitted by the photosensor 38 to an exit aperture and another branch 44*b* of the bifurcated fiber optic receives light through an entrance aperture and returns the received light to the photosensor 38. The exit and entrance apertures are aligned axially to establish a light beam between them. The light beam exiting the exit aperture is aimed at the exit aperture so that a substantial portion of the light emitted from the exit aperture is received by the entrance aperture.

The photoelectric sensor 38 operates in an opposed sensing mode, often referred to as direct or beam-break scanning. The light beam is blocked or interrupted by the presence of the leading edge 42 of one of the blanks 16, which is typically formed of a foldable material that is opaque. The pattern controller 34 continuously monitors the status of the output signal from the photosensor 38. When the light beam is interrupted, the pattern controller 34 is informed by the absence of an output signal that the leading edge 42 of one of the blanks 16 is at a given distance along the machine direction 20 from the slot nozzles 32 of the coating head 12. The pattern controller 34 can then invoke its programming to actuate the solenoid valves 30 to the open condition for an application time sufficient for adhesive guns 26 to apply the transverse bead 14 of adhesive. It is apparent to those of ordinary skill in the art that the photosensor 38 may operate in a retroreflective sensing mode in which branches 44*a, b* are adjacent and on the same side of the blanks 16.

With reference to FIGS. 6–9, the right-angle gluer 10 includes a pivotal mounting assembly 50 for the coating head 12 and a backup plate or lower bracket 52 located beneath the paper line of the gluer 10. The mounting assembly 50 includes a roll bracket 54, a box or support frame 56 pivotally attached about a pitch axis of rotation 53 to the roll bracket 54, a head mounting block 58 for the coating head 12, a clamping block 60 to which the roll bracket 54 is rotatably attached about a roll axis 51 for rotation, a pitch adjustment mechanism 64, and a height-adjustment mechanism 62. The coating head 12 is mechanically coupled to the pivotal mounting assembly 50 such that it has two degrees of rotational freedom about the roll and pitch axes 51, 53, respectively, and one degree of translational freedom vertically. The height-adjustment mechanism 62 is capable of moving the roll bracket 54 and coating head 12 vertically relative to the paper line 39. The pitch adjustment mechanism 64 permits tiltable adjustment of the coating head 12 about pitch axis 53 relative to the paper line 39 for varying the pitch of the curved contact surface 35 of slot nozzle 32 relative to the blanks 16.

With reference to FIG. 6, the clamping block 60 is secured to a square support beam 66 that extends between a transversely-spaced pair of support members 68, 69 mounted to the upper carriage 17 of the conveyor system. The support beam 66 is mechanically fixed to the support members 68, 69. The support beam 66 is received within a transversely-oriented rectangular recess 70, best shown in FIG. 8, formed in the clamping block 60. A pair of spaced-apart thumb screws 72, each having an oversized disk-shaped head, captures the support beam 66 within the recess 70.

With reference to FIGS. 7–11, the roll bracket 54 is rotatably attached to the clamping block 60. As a result and as illustrated in FIG. 6, the roll bracket 54, head mounting block 58, coating head 12, pitch adjustment mechanism 64, and height-adjustment mechanism 62 may be rolled about the roll axis 51 of rotation, which is aligned generally parallel to the machine direction 20.

Figure 7:
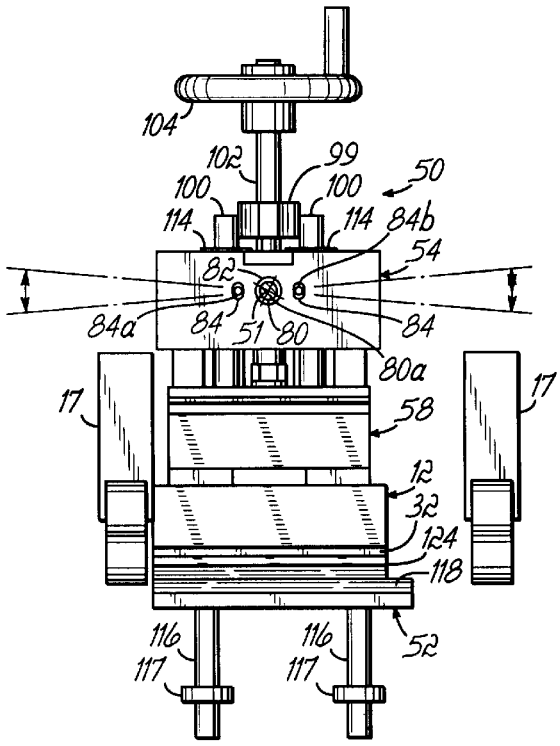
FIG. 7 is an end view of the right-angle gluer of FIGS. 4–6 illustrating angular adjustability about a roll axis of rotation.
Figure 10:
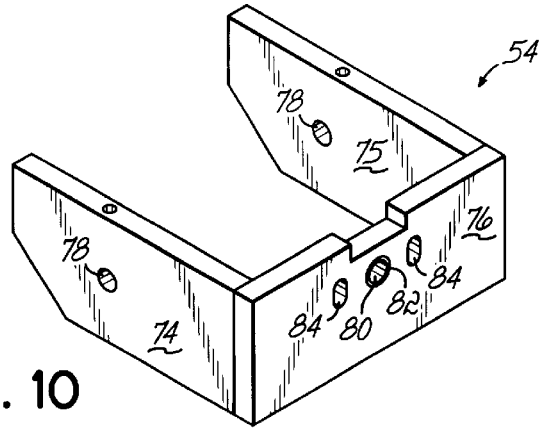
FIG. 10 is a view of a bracket according to the principles of the invention.
Figure 11:
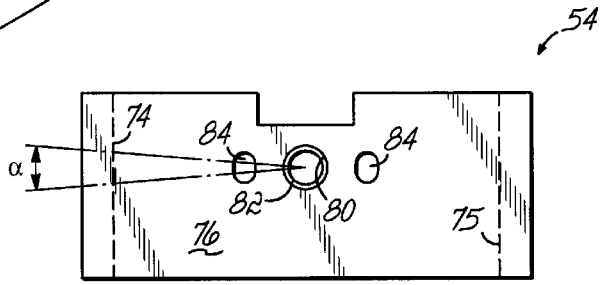
FIG. 11 is an end view of the bracket of FIG. 10.

With reference to FIGS. 10 and 11 in which the roll bracket 54 is shown in isolation, the roll bracket 54 is C-shaped and includes a pair of parallel side arms 74, 75 projecting outwardly from a transversely-oriented rear plate 76. One transversely-oriented throughbore 78 is provided in each of the side arms 74, 75 and the centerlines of the throughbores 78 are coaxial. The rear plate 76 of the roll bracket 54 includes a circular throughbore 80 having therein a sleeve bearing 82 and a pair of slotted throughbores 84 flanking the circular throughbore 80 or opposite transverse sides. The sleeve bearing 82, typically brass, facilitates the relative rotation about roll axis 51. The slotted throughbores 84 have a curved major axis that is generally oriented vertically relative to the planar surface of blank 16. The major axis of each slotted throughbore 84 is aligned with a common arc or bolt circle having a radius centered on the circular bore 80. A pivot pin 80*a,* which may assume the form of a shoulder bolt, projects outwardly from the clamping block 60 and is received in the circular throughbore 80. A pair of guide pins 84*a, b* also project outwardly from the clamping block 60 and flank the pivot pin. The guide pins are received within or protrude into respective ones of the slotted throughbores 84. The guide pins include fastening structure capable of locking or fixing the roll angle about roll axis 51 of the roll bracket 54 relative to the clamping block 60 once a desired roll angle is established. As illustrated in FIG. 7, the roll bracket 54 and its attached components may be rolled about the roll axis 51 presented by the pivot pin 80*a* through a total angle, α, of about 10°, which represents a roll of about 5° from horizontal (parallel to the plane of blank 16) to either the left or the right for the coating head 12. The roll axis 51 is substantially parallel to, or aligned with, the machine direction 20. Rotating the coating head 12 about the roll axis 51 adjusts the roll angle of the curved contact surface 35 of the mouthpieces 33 relative to the planar surface of the blanks 16 and transverse to the paper line 39 so that the length of the discharge outlets 32 is aligned substantially parallel to the plane of the blanks 16.

Figure 8:
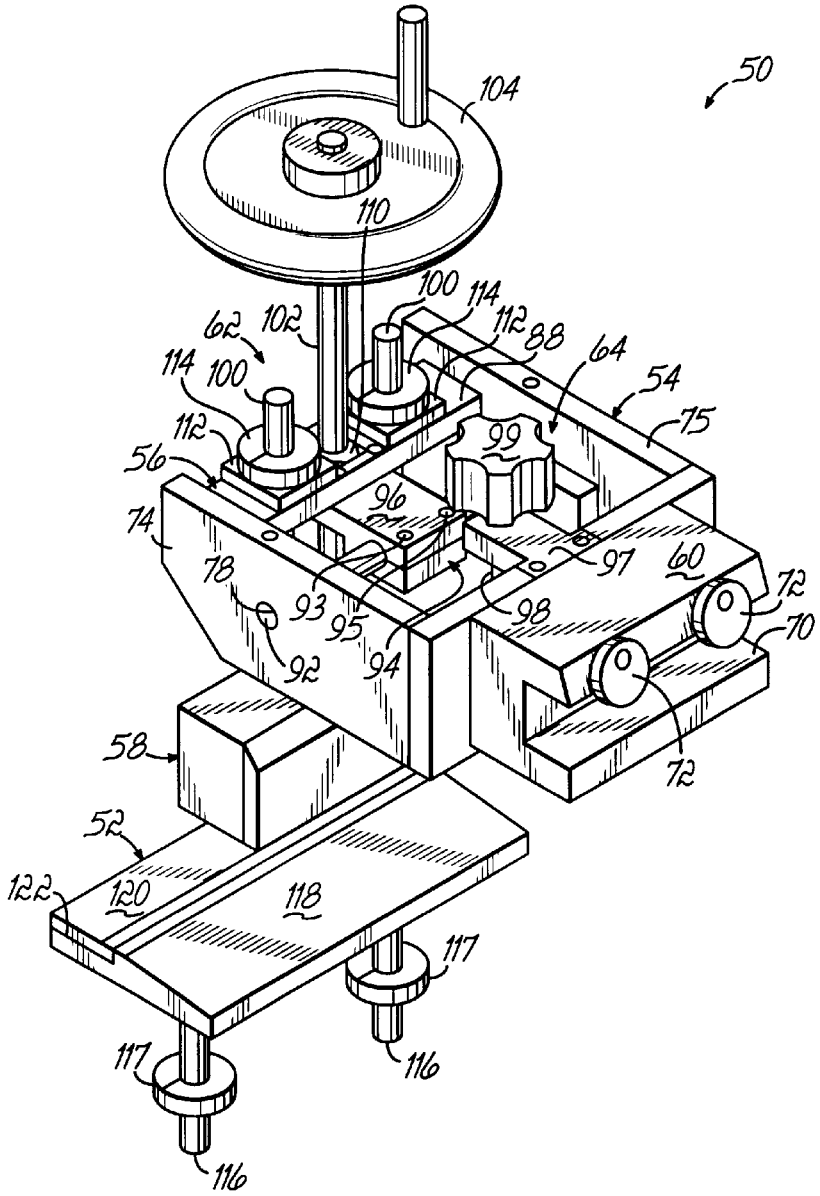
FIG. 8 is a perspective view of the pivoting moving assembly of the right-angle gluer of FIGS. 4–7 showing the mounting assembly and the lower bracket in which the material conveyor and coating head removed for clarity.
Figure 9:
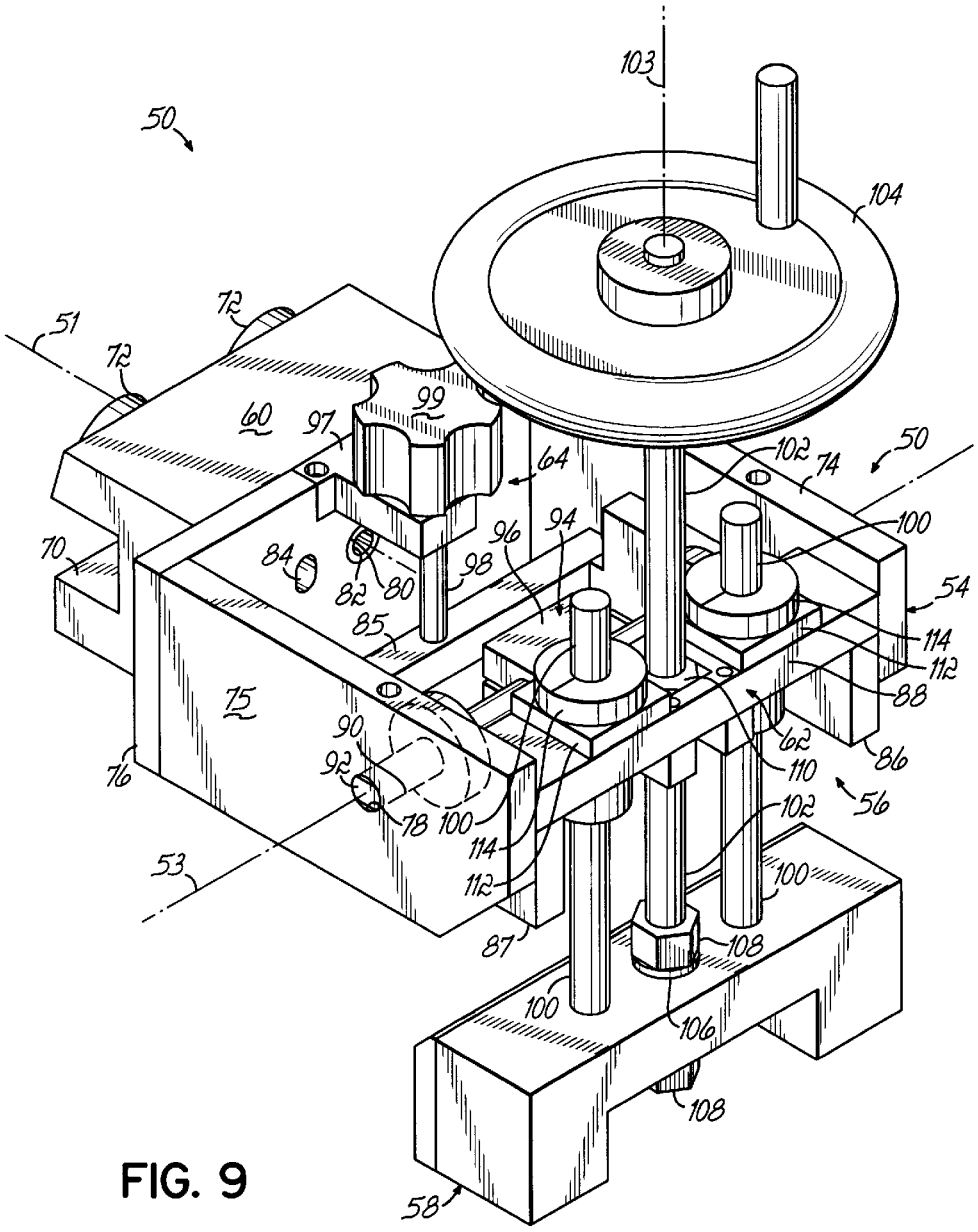
FIG. 9 is an enlarged view of a portion of FIG. 8.

With reference to FIGS. 8 and 9, disposed between the side arms 74, 75 is the support frame 56. Support frame 56 has a rear frame member 85, a pair of parallel side frame members 86, 87 and a screw plate or front frame member 88. The front and rear frame members 88, 85 extend transversely between the side frame members 86, 87 and are attached thereto with a plurality of conventional fasteners. Each side frame member 86, 87 has a transversely-oriented circular throughbore 90, which is generally aligned with the throughbores 78 in the side arms 74, 75. A transversely-oriented shaft 92 is journaled with the throughbores 78 in the roll bracket 54 and the throughbores 90 in the support frame 56. Set screws threadingly received in complementary threaded bores in each of the side arms 74, 75 engage the outer cylindrical surface of the shaft 92 so that the shaft 92 cannot rotate relative to the roll bracket 54. The support frame 56 is pivotable relative to the roll bracket 54 about pitch axis 53, which is aligned with a longitudinal axis of the shaft 92. The pitch axis 53 is substantially orthogonal to the roll axis 51, as described above, and represents a second degree of rotational freedom for adjusting the orientation of the coating head 12 and the curved contact surfaces 35 relative to the surface of the blank 16 so that the discharge outlets 32 are positioned properly relative to the plane of the blanks 16. The pitch axis 53 is also substantially orthogonal to the machine direction 20.

As a result of the ability of the support frame 56 to rotate about the transversely-oriented shaft 92 relative to the roll bracket 54, the coating head 12 may be, if not locked in position, freely cantilevered relative to the shaft 92. Gravitational force normally maintains the slot nozzles 32 of the coating head 12 in contact with the surface of the blank 16. For certain types of blanks (not shown), the periodic contact between the slot nozzles 32 of the coating head 12 and the blanks 16 may produce intermittent vertical movement of the coating head 12, which causes the support frame 56 to rotate about the shaft 92 relative to the roll bracket 54.

With reference to FIGS. 4, 8 and 9, the free rotation of the support frame 56 may be dampened or prevented with a brake clamp 94, which is operably coupled with the shaft 92. The brake clamp 94 includes a split block 96 having a transverse bore through which the shaft 92 extends and a pair of threaded fasteners 93, 95, such as pin nuts, are received in a pair of aligned threaded holes in the two halves of the split block 96. Advancement of the threaded fasteners 93, 95 in the threaded holes closes the gap in the split block 96 for selectively applying a clamping force that grips the outer circumference of the shaft 92. The clamping force is lessened or eliminated by withdrawing the threaded fasteners 93, 95. The clamping force applied by the brake clamp 94 retards or inhibits the rotation of the support frame 56 about the shaft 92 relative to the roll bracket 54 and thereby dampens or prevents any rotation of the coating head 12 about the pitch axis 53.

With reference to FIGS. 6, 8 and 9, the pitch adjustment mechanism 64 includes a flange 97 projecting outwardly from the rear plate 76 of the roll bracket 54 to overlie the rear frame member 85 and a threaded vertical shaft 98. Shaft 98 extends vertically through a threaded hole in the flange 97 and into a blind bore in the rear frame member 85. The threaded hole and the blind bore are coaxially aligned in a vertical direction. With reference to the machine direction 20, the threaded shaft 98 is disposed on the opposite side of the moment arm represented by the roll bracket 54 and support frame 56 from the weight of the coating head 12. By advancing or withdrawing the threaded shaft 98 using an adjustment knob 99, the angular orientation of the support frame 56 can be adjusted relative to the roll bracket 54 and relative to the transverse pitch axis of rotation of the shaft 92. Because the coating head 12 is on the opposite side of the moment arm from the pitch adjustment mechanism 64, the coating head 12 rotates angularly or pitches relative to the pitch axis 53 as the threaded shaft 92 is adjusted. Operation of the pitch adjustment mechanism 64 varies the pitch of the curved contact surface 35 of the mouthpieces 33 of the slot nozzles 32 in small angular increments about pitch axis 53 relative to the planar surface of the blanks 16 and relative to the paper line 39.

With continued reference to FIGS. 6–9, the height-adjustment mechanism 62 includes a pair of vertical guide rods 100, a vertical threaded shaft 102, and a hand wheel 104 attached at one end of the threaded shaft 102. The opposite end of the threaded shaft 102 is rotatably coupled with a bore extending vertically through the head mounting block 58. A thrust bearing 106*a,b* and a nut 108*a,b* are positioned proximate to each of the upper entrance to the bore and the lower entrance to the bore. The nuts 108*a,b* are tightened to capture the corresponding one of the thrust bearings 106*a,b* and to provide a rotatable mechanical connection of the threaded shaft 102 with the mounting block 58. A nut 110 (FIG. 9) is irrotationally affixed in a stationary position within a bore extending through the front frame member 88. A central portion of the shaft 102 is threadingly received within the nut 110. The hand wheel 104 is used to crank the shaft 102, which rotates freely relative to the head mounting block 58 and threadingly moves vertically within the nut 110. The rotation of the shaft 102 raises or lowers, depending upon the rotational direction of hand wheel 104, the head mounting block 58 relative to the support frame 56 and roll bracket 54 to thereby move the coating head 12 vertically relative to the paper line 39 and relative to the blank 16.

With continued reference to FIGS. 6–9, the guide rods 100 flank the shaft 102 on opposite transverse sides and function to eliminate or constrain any rotation of the head mounting block 58 relative to a vertical yaw axis 103 aligned parallel to a longitudinal axis of the threaded shaft 102. Each guide rod 100 extends though an aperture in the front frame member 88. Each aperture is provided a flange bearing 112 to provide a smooth, reduced-friction vertical movement of each guide rod 100 through the respective aperture. Disposed atop each of the guide rods 100 are split collars 114 that collectively serve as a stop for vertical movement of the head mounting block 58 and coating head 12 relative to the support frame 56 and roll bracket 54. The location of each of the split collars 114 is adjustable so that the stop position for the coating head 12 can be specified and changed accordingly.

As shown in FIG. 6, it is apparent that the coating head 12 can be pivoted about pitch axis 53 through a relatively large pitch angle, compared to the small pitch angle adjustments provided by pitch adjustment mechanism 64. Due to the enclosed "tunnel" created by the endless belts of the upper and lower carriages 17, 18 (FIG. 4), the ability to pivot the coating head 12 through such large pitch angles about pitch axis 53 permits convenient access the paper path or to the coating head 12 to perform maintenance, such as cleaning the coating head 12. For example, this feature permits the clearing of a paper jam or the removal of excess adhesive from surfaces of the slot nozzles 32 in the event of a misfire.

With reference to FIGS. 6–8, the lower bracket 52 is positioned below the paper line 39 as blanks 16 are conveyed past the right-angle gluer 10 and upstream of the slot nozzles 32 of the coating head 12. The lower bracket 52 is positioned transversely so that its major axis is generally aligned, relative to the machine direction 20, with the discharge outlets in the slot nozzles 32. The lower bracket 52 is supported on a pair of shafts 116, that extend upwardly from the chassis of the lower carriage 18. The height of the lower bracket 52 relative to the paper line is adjustable by moving positions of the split collars 117 vertically relative to the chassis.

As best shown in FIG. 8, the lower bracket 52 includes a generally rectangular support plate 118 formed of a stainless steel and a rectangular insert 120 attached with conventional fasteners to a transverse recess 122 formed in the plate 118. The insert 120 is formed of a reduced-friction material, such as a polymer, having a reduced sliding coefficient of friction when in sliding contact with the blank 16. A suitable polymer is selected from a family of fluoropolymers that includes polytetrafluoroethylene (PTFE), fluorinated ethylene propylene (FEP), and perfluoroalkoxy copolymer (PFA), which are collectively marketed under the trade name TEFLON® by E. I. du Pont de Nemours and Company (Wilmington, Del.). The support plate 118 has a wedge-shaped cross-sectional profile viewed in the transverse direction.

Figure 13:
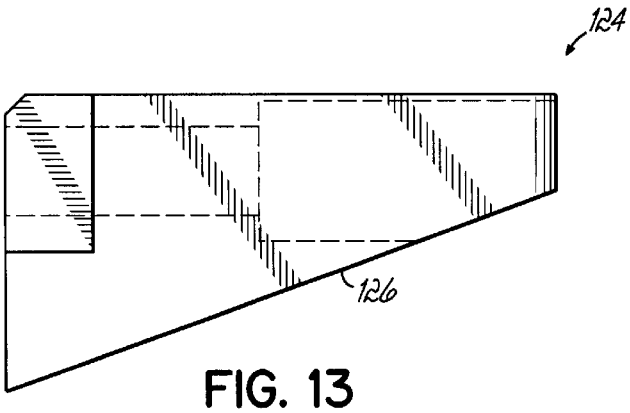
FIG. 13 is a side view of the mouthpiece adapter of the present invention.

With reference to FIGS. 4, 6 and 13, a mouthpiece adapter 124 is attached to an upstream side of the coating head 12. Specifically, the mouthpiece adapter 124 is mounted with conventional fasteners to one or more of the mouthpieces 33 of the slot nozzles 32. The mouthpiece adapter 124 is wedge-shaped and includes a beveled edge 126 that faces opposite to the machine direction 20 and toward the arriving blanks 16. The beveled edge 126 deflects any upwardly projecting portions of blank 16, such as the tabbed edges 16*d,e,* downwardly before the leading edge of blank 16 is captured between the lower bracket 52 and the slot nozzles 32.

The mouthpiece adapter 124 smoothes the entry of the leading edge of the blank 16 to the proximity of the slot nozzles 32. The lower bracket 52 enhances the control of the contact between the blanks 16 and the mouthpieces 33 of the coating head 12. Because the mouthpiece 33 of each nozzle 32 is located below the paper line 39, the coating head 12 applies a downward force to the blank 16. The upstream-facing, wedge shape of the support plate 118 operates to locally raise the paper path relative to the slot nozzles 32. The lower bracket 52 and the mouthpiece adapter 124 collectively or singularly prevent or reduce the incidence of buckling and retarded advance of the blank 16, in reaction to the downward force of the coating head 12, as the leading edge 42 of the blank approaches the coating head 12. If the retardation of the blank advance were not eliminated, the pattern controller 34 could not reproducibly locate the transverse bead 14 relative to transverse tabbed edge 16*e* and in response to the trigger signal from the photosensor 38. For accurate placement of the transverse bead 14 in the machine direction 20, the pattern controller 34 relies upon a repeatable reliable amount of time lapsing from the detection of the leading edge of the blank 16 by photosensor 38 until the transverse tabbed edge 16*e* is properly positioned relative to the discharge orifices 32*a*. In addition, the presence of the lower bracket 52 and the mouthpiece adapter 124 reduce the probability of one of the blanks 16 becoming trapped between the slot nozzles 32 and the lower bracket 52. As a result, the incidence of paper jams is lessened in the right angle gluer 10.

In use, one of the blanks 16 is conveyed toward the right-angle gluer 10. The photosensor 38 detects a leading edge 42 of the blank 16 and provides a trigger signal to the pattern controller 34. The pattern controller 34 responds to the trigger signal by implementing a set of pre-programmed instructions. Accordingly, the pattern controller 34 instructs the solenoid valves 30, in accordance with the intrinsic cycle time of each adhesive gun 26 and solenoid valve 30, to operate for providing the open condition of the valve assemblies of the respective adhesive guns 26. While in the open condition, adhesive flows from the slotted discharge outlets 32*a* onto the transverse flap 16*c* of the blank 16 for an application time sufficient to generate the transverse adhesive bead 14. The pattern controller 34 instructs the solenoid valves 30 to operate for providing the closed condition that discontinues the flow of adhesive to the slot nozzles 32. The photosensor 38 detects a leading edge 42 of another blank 16 arriving on the conveyor system and the process repeats.

The mounting assembly 50 permits the orientation of the coating head 12 to be adjusted relative to the planar surface of the blank 16 for optimizing the characteristics of the transverse bead 14 of adhesive, including uniformity of application. To that end and as described above, the coating head 12 is adjustable with two degrees of rotational freedom and one degree of translation freedom relative to the planar surface of the blank 16 and the machine direction 20. The ability to raise and lower the coating head 12 vertically relative to the paper line permits the right-angle gluer 10 to accommodate blanks 16 of differing thicknesses. In addition, the pitch degree of freedom of the coating head 12 is used to adjust the adhesive cut-off. Finally, the coating head 12 is adjustable with a rolling degree of freedom to ensure transverse uniformity of the amount of adhesive constituting the transverse bead 14.

While the above description and accompanying drawings set forth various embodiments of the invention, it will be apparent to those skilled in the art that additions and modifications may be made without departing from the principles of the invention. For example, two of the right-angle gluers may be serially and symmetrically arranged along the paper path of the production line to apply transverse beads of adhesive to two flaps for adhesive bonding on opposite side edges of a blank for the purpose of creating a two-pocket assembly. Accordingly, what is claimed is:

What is claimed is:

1. A dispensing system for applying a transverse bead of adhesive to a blank traveling in a first direction, comprising:

a coating head capable of applying the bead of the adhesive to the blank in a second direction substantially orthogonal to the first direction;

a mounting assembly orienting said coating head in the second direction, said mounting assembly including a bracket pivotal about a roll axis aligned substantially parallel to the first direction and then capable of being fixed for angularly adjusting a roll angle of said coating head relative to a plane containing the first and second directions; and a height-adjustment mechanism coupled with said bracket and capable of moving said coating head relative to said bracket in a direction substantially orthogonal to the plane containing the first and second directions.

2. The dispensing system of claim 1 further comprising a pattern controller for regulating the application of adhesive from said coating head to the blank.

3. The dispensing system of claim 2 further comprising a photosensor for detecting an edge of the blank, said photosensor providing a signal to said pattern controller for use in triggering the application of adhesive from said coating head to the blank.

4. The dispensing system of claim 2 further comprising a bifurcated fiber optic interfaced with said photosensor, said fiber optic including an emitter aperture and a receiver aperture aligned with said emitter aperture so that said photosensor operates in an opposed sensing mode.

5. The dispensing system of claim 1 wherein said coating head includes an adhesive manifold, a plurality of adhesive guns mounted to said adhesive manifold, and a plurality of slot nozzles each having a discharge outlet, said adhesive guns capable of directing a controlled flow of adhesive to said discharge outlets for applying the transverse bead of adhesive to the blank.

6. The dispensing system of claim 5 wherein said adhesive guns are actuated pneumatically and further comprising a plurality of solenoid valves each operably coupled to one of said adhesive guns for selectively supplying pressurized actuation air for actuating said adhesive gun between a closed position in which the flow of adhesive is prevented to said discharge outlet and an open position in which adhesive is applied from said discharge outlet to the blank.

7. The dispensing system of claim 6 further comprising a pattern controller operably coupled with said solenoid valves for regulating the application of adhesive.

8. The dispensing system of claim 1 further comprising a lower bracket disposed upstream in the first direction from said coating head for applying an upward force against the blank.

9. The dispensing system of claim 8 wherein said lower bracket includes a reduced friction strip contacting the blank, said strip positioned adjacent to said coating head for reducing the incidence of blank buckling.

10. The dispensing system of claim 8 wherein said lower bracket includes a wedge-shaped plate for guiding the blank vertically toward said coating head.

11. The dispensing system of claim 1 wherein said height-adjustment mechanism includes a mounting block supporting said coating head, and a rotatable threaded rod interconnecting said mounting block with said mounting assembly, said threaded rod rotatably coupled with said head mounting block and threadingly coupled with said mounting assembly so that rotation of said threaded rod moves said mounting block vertically relative to the plane.

12. The dispensing system of claim 11 wherein said mounting assembly further includes a stop providing a limit on the vertical movement of said head mounting block vertically relative to the plane.

13. The dispensing system of claim 11 wherein said mounting assembly further includes a pair of guide rods flanking said threaded rod on opposite sides parallel to said second direction, said pair of guide rods capable of limiting the rotation of said mounting block about a yaw axis substantially parallel to said threaded rod and substantially orthogonal to the plane containing the first and second directions.

14. The dispensing system of claim 1 wherein the mounting assembly is constructed and arranged such that said coating head can be angularly pivoted about a pitch axis of rotation substantially parallel to the second direction and to a fixed pitch angle relative to the plane containing the first and second directions.

15. The dispensing system of claim 1 wherein said coating head further includes a beveled edge disposed upstream in the first direction from said coating head for deflecting any upwardly-projecting portions of the blank downwardly before the transverse bead of adhesive is applied to the blank by said coating head.

16. A dispensing system for applying a transverse bead of adhesive to a blank, traveling in a first direction, comprising:

a coating head capable of applying the transverse bead of the adhesive to the blank in a second direction substantially orthogonal to the first direction; and a mounting assembly orienting said coating head in the second direction, said mounting assembly including a first bracket and a second bracket, said second bracket carrying said coating head and pivotally coupled to said first bracket along a pitch axis substantially parallel to the second direction for adjusting a pitch angle of said coating head, and said first bracket and said second bracket being rotatable about a roll axis aligned substantially parallel to the first direction for adjusting a roll angle of said coating head.

17. The dispensing system of claim 16 further comprising a pattern controller for regulating the application of adhesive from said coating head to the blank.

18. The dispensing system of claim 17 further comprising a photosensor for detecting an edge of the blank, said photosensor providing a signal to said pattern controller for use in triggering the application of adhesive from said coating head to the blank.

19. The dispensing system of claim 17 further comprising a bifurcated fiber optic interfaced with said photosensor, said fiber optic including an emitter aperture and a receiver aperture aligned with said emitter aperture so that said photosensor operates in an opposed sensing mode.

20. The dispensing system of claim 17 wherein said coating head includes an adhesive manifold, a plurality of adhesive guns mounted to said adhesive manifold, and a plurality of slot nozzles each having a discharge outlet, said adhesive guns capable of directing a controlled flow of adhesive to said discharge outlets for applying the transverse bead of adhesive to the blank.

21. The dispensing system of claim 20 wherein said adhesive guns are actuated pneumatically, and further comprising a plurality of solenoid valves each operably coupled to one of said adhesive guns for selectively supplying pressurized actuation air for actuating said adhesive gun between a closed position in which the flow of adhesive is prevented to said discharge outlet and an open position in which adhesive is applied from said discharge outlet to the blank.

22. The dispensing system of claim 21 further comprising a pattern controller operably coupled with said solenoid valves for regulating the application of adhesive.

23. The dispensing system of claim 16 further comprising a lower bracket disposed upstream in the first direction from said coating head for applying an upward force against the blank.

24. The dispensing system of claim 23 wherein said lower bracket includes a reduced friction strip contacting the blank, said strip positioned adjacent to said coating head for reducing the incidence of blank buckling.

25. The dispensing system of claim 23 wherein said tower bracket includes a wedge-shaped plate for guiding the blank vertically toward said coating head.

26. The dispensing system of claim 16 wherein the mounting assembly is constructed and arranged such that said coating head can be moved substantially vertically over a range of movement relative to a plane containing the first and second directions.

27. The dispensing system of claim 26 wherein said mounting assembly includes a mounting block supporting said coating head, and a rotatable threaded rod interconnecting said mounting block with said second bracket, said threaded rod rotatably coupled with said head mounting block and threadingly coupled with said first bracket so that rotation of said threaded rod moves said mounting block vertically relative to the plane.

28. The dispensing system of claim 27 wherein said mounting assembly further includes a stop providing a limit on the vertical movement of said head mounting block vertically relative to the plane.

29. The dispensing system of claim 27 wherein said mounting assembly further includes a pair of guide rods flanking said threaded rod on opposite sides parallel to said second direction, said pair of guide rods capable of limiting the rotation of said mounting block about a yaw axis substantially parallel to said threaded rod and substantially orthogonal to the plane.

30. The dispensing system of claim 28 wherein said stop extends between said first bracket and said second bracket.

31. The dispensing system of claim 16 wherein said mounting assembly further includes a brake clamp capable of selectively inhibiting the rotation of said said second bracket about said pitch axis.

32. The dispensing system of claim 16 wherein said coating head further includes a beveled edge disposed upstream in the first direction from said coating head for deflecting any upwardly-projecting portions of the blank downwardly before the transverse bead of adhesive is applied to the blank by said coating head.

33. The dispensing system of claim 16 wherein said first bracket is capable of being fixed at the roll angle.

34. The dispensing system of claim 16 wherein the pitch angle is adjustable between a first angular orientation in which said coating head contacts the blank and a second angular orientation in which said coating head is separated from the blank, said mounting assembly including a pitch-adjustment mechanism for adjusting a value of the first angular orientation.

35. A dispensing system for applying a transverse bead of adhesive to a blank traveling in a first direction, said dispensing system comprising:

a coating head capable of applying the bead of the adhesive to the blank in a second direction substantially orthogonal to the first direction; and a mounting assembly orienting said coating head in the second direction, said mounting assembly including a bracket pivotal about a pitch axis aligned substantially parallel to the second direction and then capable of being fixed at a pitch angle for angularly adjusting a pitch angle of said coating head relative to a plane containing the first and second directions; and a height-adjustment mechanism coupled with said bracket and capable of moving said coating head relative to said bracket in a direction substantially orthogonal to the plane containing the first and second directions.

36. The dispensing system of claim 35 wherein the pitch angle is adjustable between a first angular orientation in which said coating head contacts the blank and a second angular orientation in which said coating head is separated from the blank, said mounting assembly including a pitch-adjustment mechanism for adjusting a value of the first angular orientation.

37. The dispensing system of claim 35 further comprising a lower bracket disposed upstream in the first direction from said coating head for applying an upward force against the blank.

38. The dispensing system of claim 37 wherein said lower bracket includes a reduced friction strip contacting the blank, said strip positioned adjacent to said coating head for reducing the incidence of blank buckling.

39. The dispensing system of claim 37 wherein said lower bracket includes a wedge-shaped plate for guiding the blank vertically toward said coating head.

40. The dispensing system of claim 35 wherein said height-adjustment mechanism further includes a stop providing a limit on the vertical movement of said coating head vertically relative to the plane.

41. The dispensing system of claim 35 wherein said height-adjustment mechanism includes a mounting block supporting said coating and a rotatable threaded rod interconnecting said mounting block with said mounting assembly, said threaded rod rotatably coupled with said head mounting block and threadingly coupled with said mounting assembly so that rotation of said threaded rod moves said mounting block vertically relative to the plane.

42. The dispensing system of claim 41 wherein said mounting assembly further includes a stop providing a limit on the vertical movement of said head mounting block vertically relative to the plane.

43. The dispensing system of claim 41 wherein said mounting assembly further includes a pair of guide rods flanking said threaded rod on opposite sides parallel to said second direction, said pair of guide rods capable of limiting the rotation of said mounting block about a yaw axis substantially parallel to said threaded rod and substantially orthogonal to the plane.

44. The dispensing system of claim 35 wherein said mounting assembly further includes a brake clamp capable of selectively inhibiting the rotation of said bracket about said pitch axis.

45. The dispensing system of claim 35 wherein said coating head further includes a beveled edge disposed upstream in the first direction from said coating head for deflecting any upwardly-projecting portions of the blank downwardly before the transverse bead of adhesive is applied to the blank by said coating head.

* * * * *

UNITED STATES PATENT AND TRADEMARK OFFICE

CERTIFICATE OF CORRECTION

PATENT NO. : 6,673,152 B2
DATED : January 6, 2004
INVENTOR(S) : Robert D. Guzzon et al.

It is certified that error appears in the above-identified patent and that said Letters Patent is hereby corrected as shown below:

Column 2,
Line 67, change “glue” to -- gluer --.

Column 3,
Line 6, change “glue” to -- gluer --.
Line 40, insert -- are -- after “head”.

Column 4,
Line 25, change “16e” to -- 16d --.

Column 5,
Line 31, change “6aA” to -- 6A --.
Line 41, change “cross-sectional” to -- cross section --.

Column 7,
Line 50, change the second occurrence of “exit” to -- entrance --.

Column 11,
Line 4, insert -- to -- after “access”.

Column 14,
Line 65, change “tower” to -- lower --.

Column 15,
Line 29, delete the first occurrence of “said”.
Line 51, delete “and”.

Signed and Sealed this

Fifth Day of April, 2005

JON W. DUDAS
*Director of the United States Patent and Trademark Office*